US005197925A

United States Patent [19]

Cunard

[11] Patent Number: 5,197,925

[45] Date of Patent: Mar. 30, 1993

[54] FLEXIBLE SWING SEAT AND METHOD OF ASSEMBLING SAME

[75] Inventor: Joel C. Cunard, Bedford, Pa.

[73] Assignee: Hedstrom Corporation, Bedford, Pa.

[21] Appl. No.: 808,910

[22] Filed: Dec. 17, 1991

[51] Int. Cl.[5] ..... A63G 9/00

[52] U.S. Cl. ..... 472/118; 297/74; 297/273; 297/452

[58] Field of Search ..... 472/118-125; 297/273, 452, 445, 74

[56] References Cited

U.S. PATENT DOCUMENTS

| | | | |
|---|---|---|---|
| 2,444,618 | 7/1948 | Seamster | 472/118 |
| 3,088,734 | 5/1963 | Grudoski | 472/118 |
| 3,260,522 | 7/1966 | White et al. | 472/118 |
| 3,462,195 | 3/1969 | Allen | 472/118 X |
| 3,712,614 | 1/1973 | Sherman et al. | 472/118 |
| 3,897,056 | 7/1975 | Hock et al. . | |
| 4,478,410 | 10/1984 | Ziegler, Jr. . | |
| 4,793,607 | 12/1988 | Suellentrop | 472/118 |

*Primary Examiner*—Richard E. Chilcot, Jr.
*Attorney, Agent, or Firm*—Cesari and McKenna

[57] ABSTRACT

A children's swing comprises a generally rectangular strap-like seat having a flat resilient main body and a pair of tubes extending along the underside of said body adjacent to the longitudinal edges thereof. A pair of hangers project from the opposite ends of the tubes, each hanger having a pair of arms which diverge a distance comparable to the spacing of the pair of tubes and parallel end segments which extend from those arms an appreciable distance into the ends of the tubes. A pair of flexible inextensible connector segments are positioned in the pair of tubes and the opposite ends of the connector segments are attached to adjacent ones of the hanger end segments. The connector segments are shorter than the tubes so that these attachments are all recessed into the tubes and only small portions of the hangers project beyond the ends of the seat body, thereby minimizing the changes of the swing causing injury. A method of assembling the seat is also disclosed.

10 Claims, 2 Drawing Sheets

FLEXIBLE SWING SEAT AND METHOD OF ASSEMBLING SAME

This invention relates to a sling-type swing seat for use on a children's gym set and a method of assembling that seat.

BACKGROUND OF THE INVENTION

Many gym sets in use today have swings whose seat, instead of being a rigid platform, is a flexible strap which, when suspended by chains from the cross-bar of a gym set, forms a sling in which the child can sit comfortably. Such a flexible swing seat has a definite advantage over conventional rigid swing seats because if a moving seat happens to strike a child, the impact will not cause serious injury to the child. Also, a sling-type seat conforms to the rider's body and tends to retain the rider on the seat. Still further, the seat is more comfortable than a rigid platform-type seat.

One prior sling-type seat of which we are aware comprises a flexible rectangular strap having a pair of inextensible flexible connector members such as metal strips or chains captured by the strap adjacent to the front and rear edges thereof and extending the full length of the strap. A pair of rigid wire hangers are anchored to corresponding ends of those straps at the opposite ends of the seat, those hangers being suspended by chains from an overhead support so as to position the seat above the ground. An example of such a seat is disclosed in U.S. Pat. No. 3,897,056.

That seat is disadvantaged, however, in that it still presents some danger to children because of the rigid wire hangers which are present at the opposite ends of the seat. Those hangers are fully exposed so that if the seat is moving and one of the hangers strikes a child, the hanger can cause injury to the child. Also, the connections between the hangers and the inextensible members extending along the seat are more or less exposed and constitute pinch points which can injure the fingers of a child sitting on the seat.

A somewhat similar seat is disclosed in U.S. Pat. No. 4,478,410. This seat avoids the need for separate metal connector members in the seat and separate wire hangers by threading the seat suspension chains through integral tubes in the seat and linking the free lower end of each chain to the opposite chain just above the seat so that the chains themselves form flexible hangers. While this seat avoids the disadvantages of the first-mentioned one, it has pinch points just above the seat where the chains are linked together. Also, the links which releasably connect the chains at those locations are separate small riveted parts which are relatively expensive to make and can become lost.

SUMMARY OF THE INVENTION

Accordingly it is the object of the present invention to provide an improved swing seat of the flexible sling type.

Another object of the invention is to provide a swing incorporating a swing seat such as this which has no pinch points accessible to a child riding on the swing.

A further object of the invention is to provide a sling-type swing seat which is safe to use and which does not have large rigid exposed parts which could cause injury if the swing seat should strike a child.

Still another object of the invention is to provide a swing seat which can be assembled easily by the customer.

Yet another object of the invention is to provide a sling-type swing seat which is relatively inexpensive to manufacture.

Other objects will, in part, be obvious and will, in part, appear hereinafter.

The invention accordingly comprises the sequence of steps and the relation of one or more of such steps with respect to each of the others and the features of construction, combination of elements and arrangement of parts which are exemplified in the following detailed description, and the scope of the invention is indicated in the claims.

Briefly, my improved swing comprises a generally rectangular, flexible, strap-like seat having a pair of integral tubes at the underside of the seat adjacent to the longitudinal edges thereof. Projecting from the ends of the tubes at the opposite ends of the seat are inverted V-shaped hangers. The arms of each hanger extend into the tubes at the corresponding end of the seat and the hanger arms extending into the opposite ends of each tube are connected by an inextensible but flexible connector segment whose length is appreciably shorter than the length of the seat. Resultantly, the hangers are captured so that only a relatively small part of each hanger, constituting the base of the V, projects from the end of the seat and all of the connections to the connector segments are recessed well into the ends of the tube where they cannot be reached by a child.

The seat is suspended above the ground by suspension chains whose lower ends are connected to the base of the V-shaped hangers and whose upper ends are secured to a suitable overhead support, such as the cross-bar of a play gym.

The seat tubes, being somewhat resilient, tend to bias the unoccupied seat to a gently curved condition so that the two suspension chains are spaced apart at the ends of the seat thereby enabling the child to sit on the seat quite easily. As soon as the seat is sat upon, it flexes, assuming a sling-type configuration that conforms to the rider's body, and is quite comfortable. As soon as the child leaves the swing, the seat resumes its gently curved shape.

The present seat is safer than prior flexible swing seats typified by those shown in the above patents because the portions of the hangers that are exposed are minimized and because it has no exposed pinch points. Both of these safety features stem from the fact that the arms of the hangers are recessed into the ends of the seat tubes and are connected by connector segments within those tubes which are appreciably shorter than the length of the seat itself. These shorter-then-the-seat connector segments maintain the arms of the hangers and the attachments to the hangers within the tubes and help to prevent the seat body or strap from shifting longitudinally relative to the hangers and their internal connecter segments.

As will be seen later, the flexible resilient nature of the seat strap itself also helps to maintain the relative positions of the seat components once they are assembled in the manner to be described.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
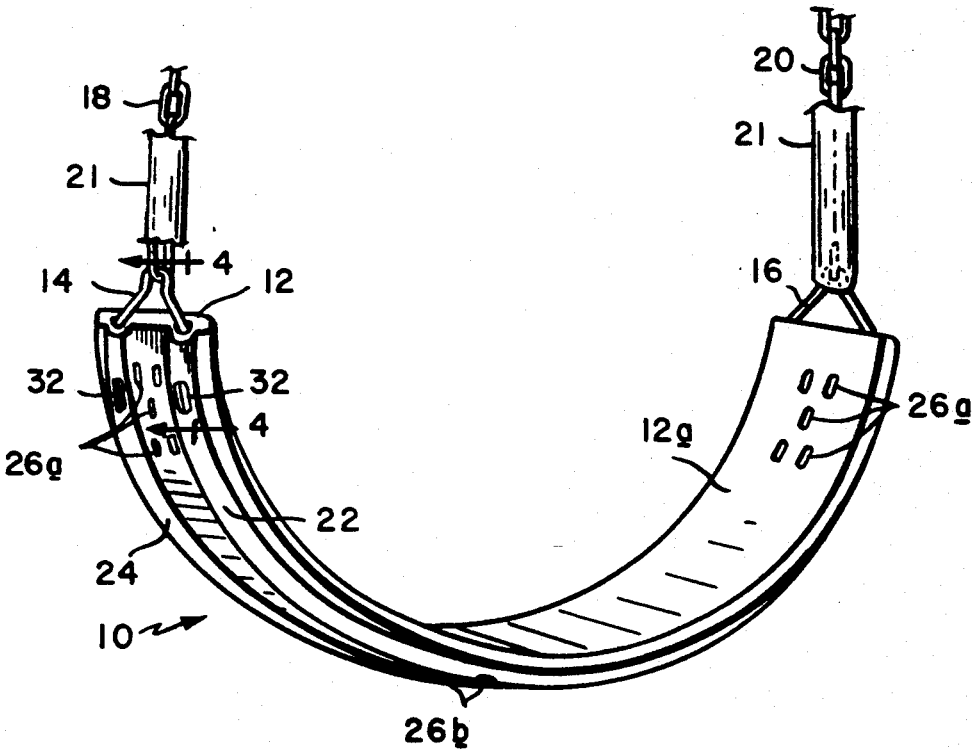
FIG. 1 is a fragmentary isometric view of a swing having a swing seat made in accordance with this invention.

Referring to FIG. 1 of the drawings, a swing incorporating my invention includes a swing seat shown generally at 10. Seat 10 includes a generally rectangular, flexible and somewhat resilient strap 12 which may be in the order of 19.5 inches long and 5.5 inches wide. Projecting slightly beyond the opposite ends of the strap is a pair of wire hangers 14 and 16. These hangers are pivotally connected to the lower ends of a pair of equal-length suspension chains 18 and 20 whose upper ends are pivotally connected to a suitable overhead support such as the cross-bar of a play gym (not shown). Desirably, the suspension chains 18 and 20 are covered by plastic sheaths 21 to provide good gripping surfaces for the occupant of the swing seat.

The strap 12 is a unitary part molded or extruded of rubber or a suitable rugged, weather-resistant plastic material such as polyethylene. The strap has a generally flat main body 12*a*. Formed at the underside of that body adjacent to the front and rear edges thereof is a pair of integral tubes 22 and 24 which preferably extend the entire length of the strap. A number of small openings or slots 26*a* may be present in the strap body 12*a* between tubes 22 and 24 inward of the strap ends. These slots provide ventilation and increase the flexibility of the strap 12 adjacent to the ends thereof where the strap is intended to curve upwardly around the seat occupant when the swing seat is in use. Similar openings or slots 26*b* are formed in the walls of tubes 22 and 24 near the middle of those tubes to prevent accumulation of rain water in the tubes when the swing is exposed to the weather.

Figure 2:
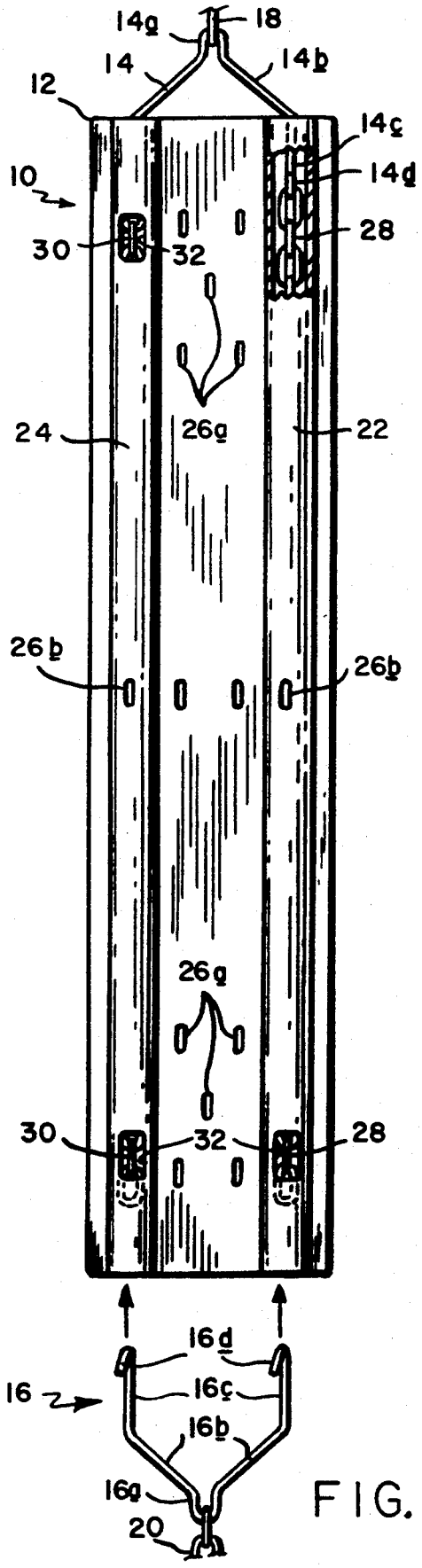
FIG. 2 is a bottom view with parts broken away showing the swing seat in a partially assembled condition.

As best seen in FIG. 2, hanger 14 is an V-shaped wire member having a loop-like base or root portion 14*a* from which arms 14*b* diverge laterally to a distance that corresponds to the center-line spacing of the strap tubes 22 and 24, e.g., 3.5 inches. Free end segments 14*c* of those arms are bent parallel to one another and extend some distance, e.g., 2 inches, being terminated by hooks 16*d*. The end segments 14*c* extend into corresponding first ends of tubes 22 and 24.

Hanger 16 is substantially identical to hanger 14 having a loop-like base 16*a*, diverging arms 16*b* and parallel end segments 16*c* extending into corresponding second ends of tubes 22 and 24 at the opposite end of strap 12.

Figure 4:
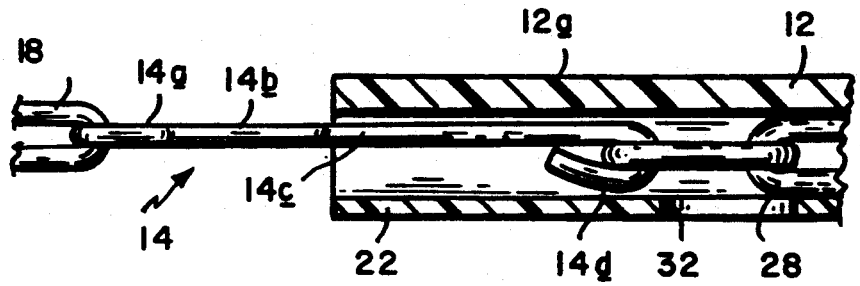
FIG. 4 is a sectional view taking along line 4—4 of FIG. 1.

The hanger end segments 14*c* and 16*c* projecting into the opposite ends of tube 22 are connected together by a connecter chain segment 28. For this, the hooks 14*d* and 16*d* at the free ends of those segments are hooked through the end links of the chain segment 28. Also, the end of the hook 14*d* is bent against arm segment 14*c* to form a closed loop around the adjacent end link as shown in FIG. 4. Hook 16*d* is closed around the link at the opposite end of chain 28 in a similar manner.

Another connecter chain segment 30 is situated in strap tube 24 and the opposite ends of that chain segment and connected to the hooks 14*d* and 16*d* at the ends of the hanger and segments 14*c* and 16*c* projecting into the opposite ends of tube 24. These hooks are bent so as to encircle the end links of chain 30 in the same manner as the hook 14*d* depicted in FIG. 4.

It is a feature of this invention that the chain segments 28 and 30 which connect hangers 14 and 16 are appreciably shorter than the seat strap 12, or more particularly, the strap tubes 22 and 24. For example, if the tubes are 19.5 inches long, the chain segments should be about 15.5 inches long. Consequently, the attachments or connections of those chains to the hangers are recessed into the tubes so that there is no way that a child's fingers can be pinched at those connections.

Also, the pairs of hanger arms 14*b* and 16*b* are relatively short and each pair defines a relatively wide angle, e.g., about 70°, so that when the hangers are connected by the chain segments 28 and 30, only a relatively small portion, e.g., about 1.75 inches, of each hanger protrudes from the end of the seat. Therefore, the chances are small of a child being struck by one of those hangers when the seat is moving.

Normally seat 10 is assembled by the customer and the procedure is as follows. First, the ends of the sheaths 21 covering suspension chains 18 and 20 are trimmed to expose the last full link of each chain. Then, one of the hangers, e.g., hanger 14, is hooked through the end link of one of those chains, i.e., chain 18, so that the link encircles the bracket base portion 14*a*. Then, the hanger hooks 14*d* are hooked through the links at corresponding ends of connecter chain segments 28 and 30 and the hooks are closed around those links by tapping the hook ends with a hammer.

Figure 3:
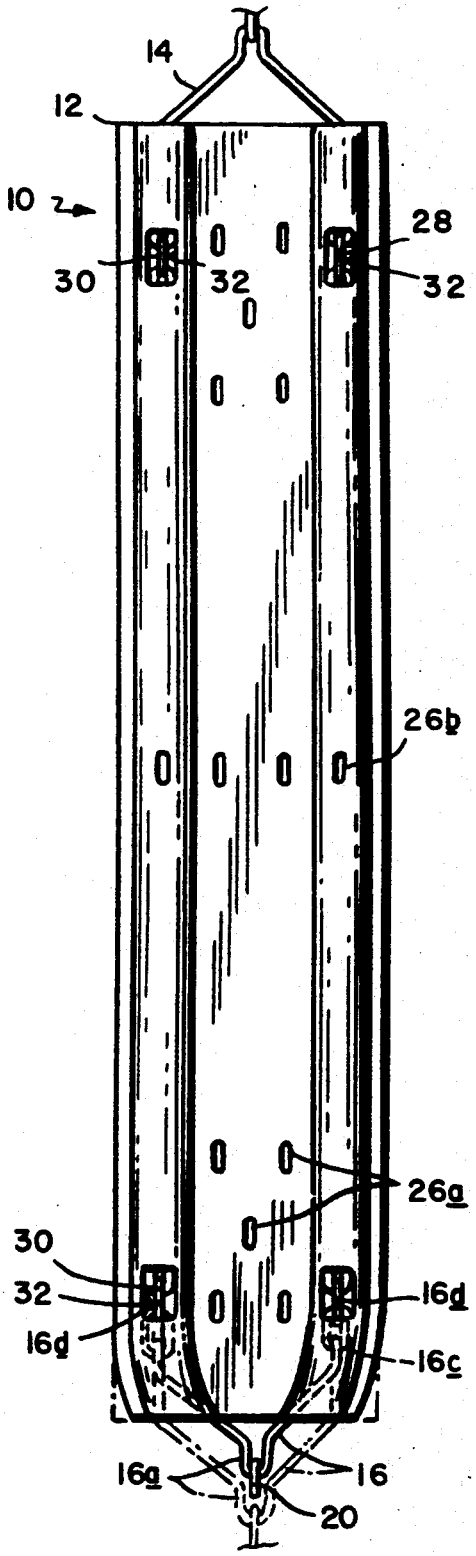
FIG. 3 is a similar view further illustrating how the seat is assembled.

Following that, the hanger 14 is suspended in the air so that the chain segments 28 and 30 hang vertically and, while also holding strap 12 vertically, the free ends of those chain segments are slid into the ends of the seat tubes 22 and 24 at one end of strap 12, as shown in FIG. 2. If necessary, a wire coat hanger may be inserted into the opposite or lower ends of the tubes and hooked onto chain segments 28 and 30 to pull the chains through the tubes. As noted above, the connecter chain segments are shorter than the tubes so that the free end links of the chain segments never reach the opposite or lower ends of the tubes 22 and 24. Rather, those end links are set in an appreciable distance, e.g., 2 inches, from the ends of the tubes. As best seen in FIGS. 2 and 3, small rectangular openings 32 are formed in the bottom walls of strap tubes 22 and 24. These openings are spaced a greater distance, e.g., 2.5 inches, from the opposite ends of those tubes so that portions of the links at the ends of chain segments 28 and 30 are exposed in the openings as shown at the lower end of the seat in FIG. 2.

Next, as shown in FIG. 3, the other hanger, i.e., hanger 16, is hooked through the end link of the other suspension chain, i.e., chain 20, and the parallel end segments 16*c* of that hanger are inserted into the opposite ends of tubes 22 and 24 so that the hooks 16*d* at the ends of those segments face away from the strap body 12*a*, i.e., toward the viewer of FIG. 3.

Following that, one arm of that hanger is pushed into one of the tubes, e.g., tube 22, so that the hook 14*d* at the end of that arm is visible in the adjacent opening 32 in that tube. The hook 14*d* at the end of that arm is then hooked to the adjacent end link of connecter chain segment 28. Usually, because of the converging hanger arms 16*b*, to make this connection, that end of the seat strap main body 12*a* has to be flexed or folded to bring the end segments of tubes 22 and 24 closer together as shown in FIG. 3. This can be accomplished because, as noted above, the seat strap body 12*a* is flexible.

Then, with strap body 12*a* still folded, the other arm of hanger 16 is pushed into the end of the other tube 24 until the upwardly facing hook 14*d* at the end of that arm is visible in the opening 32 in that tube, at which point it is hooked through the end link of the other chain segment 30.

Finally, as shown in solid lines in FIG. 3, while still flexing the seat strap 12, the hanger 16 is pushed into the ends of tubes 22 and 24 so that both hooks 16*d* are visible in their respective openings 32 and in position to be closed by tapping them with a hammer to permanently connect that hanger to chain segments 28 and 30. After that, the hanger 16 may be pulled from the ends of tubes 22 and 24, to the position shown in phantom in FIG. 3, to allow the seat strap body 12*a* to resume its unflexed condition. The seat 12 will now center itself between hangers 14 and 16 so that the hooks 14*d* and 16*d* at the ends of the hangers will all be located at positions within the tubes 22 and 24 between openings 32 and the ends of the tubes.

In other words, the hooks will be recessed well into the ends of the tubes 22 and 24, and yet will not be visible in the openings 32. Therefore, a child's fingers will not be able to reach, and possibly be pinched at, those connections either via the ends of tubes 22 and 24 or by way of openings 32. With the seat 10 now firmly attached to the suspension chains 18 and 20, the opposite ends of those chains can be connected in the usually way to a suitable support such as the cross-bar of a play gym.

Strap 12 tends to remain centered between hangers 14 and 16 even when the seat is swinging because the hanger arms 14*b* and 16*b* begin to converge right at the ends of tubes 22 and 24 as shown in FIG. 1. Therefore, the seat strap 12 cannot be slid toward either hanger 14 or hanger 16 without being bent or flexed to bring the corresponding ends of tubes 22 and 24 closer together as described above. Since the seat strap body 12*a* is resilient, it tends to remain in a flat condition from front to back so as to maintain a fixed spacing between tubes 22 and 24.

In addition, the connecter chain segments 28 and 30 fit relatively snugly in the tubes 22 and 24. Therefore, if a longitudinal or outward force is applied to one of the hangers, 14, 16, the tubes 22 and 24 tend to function as Chinese thumb traps that resist lengthwise relative motion of those chains. In other words, when an outward forces is exerted on a hanger, e.g., hanger 14, that pulling force is transmitted to the flexible tubes 22 and 24 and tends to lengthen the tubes. Such lengthening reduces the tube diameters so that they squeeze against the chain segments 28 and 30, thereby resisting further relative movement of the chain segments and strap 12. The greater the pulling force on the hanger, the tighter the tubes grip the chain segments.

It will thus be seen that the objects set forth above, among those made apparent from the preceding description, are efficiently attained. Also, certain changes may be made in the above method and construction without departing from the scope of the invention. For example, instead of using chain segments as the connectors between hangers 14 and 16, strong flexible metal straps with end openings or wire cables with end loops may be used. Therefore, it is intended that all matter contained in the above description or shown in the accompanying drawings be interpreted as illustrative and not in a limiting sense.

It is also to be understood that the following claims are intended to cover all of the generic and specific feature of the invention described herein.

I claim:

1. A swing seat comprising a generally rectangular strap-like seat having a generally flat flexible main body and a pair of tubes extending along the underside of said body adjacent to the longitudinal edges thereof;

a pair of hangers projecting slightly from the opposite ends of said pair of tubes, each hanger having a pair of arms which diverge a distance comparable to the spacing of the tubes and parallel end segments which extend an appreciable distance from said arms into the ends of the tubes;

a pair of flexible connector segments positioned in the pair of tubes, said connector segments being shorter than the tubes, and means for attaching the opposite ends of said connecter segments to adjacent ones of said hanger end segments within the pair of tubes.

2. The swing seat defined in claim 1 wherein said connecter segments comprise lengths of chain.

3. The swing seat defined in claim 1 and further including first long flexible suspension means connected at one end to one of said hangers, and second long flexible suspension means connected at one end to the other of said hangers.

4. The swing seat defined in claim 3 and further including flexible sheaths covering said first and second suspension means.

5. The swing seat defied in claim 1 and further including means defining a pair of openings in the walls of said tubes, said openings being spaced a selected distance from corresponding first ends of said tube.

6. The swing seat defined in claim 5 and further including a second pair of openings in said tube walls and spaced said selected distance from corresponding second ends of said tubes.

7. The swing seat defined in claim 5 wherein said selected distance is greater than the length of said hanger end segments.

8. The swing seat defined in claim 1 wherein said seat is resilient.

9. A swing seat comprising a generally rectangular strap-like seat having a generally flat flexible main body and a pair of tubes extending along the underside of said body adjacent to the longitudinal edges thereof;

a pair of hangers projecting slightly from the opposite ends of said tubes, each hanger having a pair of arms which diverge a distance comparable to the spacing of the tubes and parallel end segments which extend an appreciable distance from said arms into the ends of the pair of tubes;

a pair of flexible connectors segments positioned in the pair of tubes, said connector segments being shorter than said pair of tubes;

a pair of openings in the walls of said pair of tubes, said openings being spaced a selected distance from corresponding first ends of said tubes, said selected distance being greater than the lengths of said hanger segments, and attachment means on the free ends of said hanger end segments for attachment to the adjacent ends of the connector segments only when the seat main body is folded to bring the pair of tubes closer together to enable the diverging hanger arms to protrude into the ends of the tubes enough to expose the attachment means in said openings.

10. A method of assembling a swing seat composed of a generally rectangular strap-like seat having a flexible main body and a pair of spaced-apart tubes extending along the underside of said body adjacent the longitudinal edges thereof, a pair of hangers projecting from the opposite ends of said pair of tubes, each hanger having a pair of arms which diverge a distance comparable to the spacing of said pair of tubes and parallel end segments of a selected length, a pair of flexible connector segments positioned in the pair of tubes and attachment means at the ends of said hanger end segments for attachment to the adjacent ends of said connector segments, said method comprising the steps of forming a pair of openings in the walls of said pair of tubes a selected distance from corresponding first ends of said tubes, said selected distance being greater than the length of said hanger end segments;

forming said connector segments with lengths less than the lengths of said tubes;

attaching the attaching means of one hanger to corresponding first ends of said connector segments;

sliding the opposite ends of said connector segments into corresponding second ends of said tubes so that said segment opposite ends are adjacent to said tube openings;

inserting the end segments of the other hanger into said corresponding first ends of said tubes;

folding the segment of said seat body between said corresponding first ends of said tubes to enable the diverging arms of said other hanger to protrude into the corresponding first ends of said tubes enough to expose the attachment means of said second hanger in said openings;

attaching the attaching means of the second hanger to the adjacent ends of said connector segments through said openings while said seat body is folded, and releasing said seat body segment so that said seat body segment can resume its normal condition and return said corresponding first ends of said tubes to their normal spacing so that said attachment means are recessed into the ends of said tubes.

* * * * *